US010407834B1

(12) United States Patent
Li et al.

(10) Patent No.: US 10,407,834 B1
(45) Date of Patent: Sep. 10, 2019

(54) ADAPTIVE VIBRATION ISOLATOR

(71) Applicant: Sichuan University, Chengdu, Sichuan (CN)

(72) Inventors: Wenqiang Li, Sichuan (CN); Yuanming Xie, Sichuan (CN); Yan Li, Sichuan (CN)

(73) Assignee: Sichuan University, Chengdu (CN)

( * ) Notice: Subject to any disclaimer, the term of this patent is extended or adjusted under 35 U.S.C. 154(b) by 5 days.

(21) Appl. No.: 15/972,124

(22) Filed: May 5, 2018

(30) Foreign Application Priority Data

Feb. 23, 2018 (CN) ..... 2018 1 0155653

(51) Int. Cl.

| | |
|---|---|
| ***F16F 9/34*** | (2006.01) |
| ***B60K 5/12*** | (2006.01) |
| ***E01B 19/00*** | (2006.01) |
| ***E04B 1/36*** | (2006.01) |
| ***E04B 1/98*** | (2006.01) |

(52) U.S. Cl.
CPC ..... *E01B 19/003* (2013.01); *E04B 1/36* (2013.01); *E04B 1/98* (2013.01); *E01B 2204/06* (2013.01); *E01B 2204/08* (2013.01)

(58) Field of Classification Search
CPC ..... F16F 13/08; F16F 13/26; F16F 13/105; F16F 9/10; F16F 9/34; E01B 1/00; E01B 19/00
USPC ..... 267/33–35, 140.13, 120, 122, 124; 188/379–382; 248/550
See application file for complete search history.

(56) References Cited

U.S. PATENT DOCUMENTS

| | | | | |
|---|---|---|---|---|
| 3,947,007 A * | 3/1976 | Pelat | F16F 13/08 | 267/140.13 |
| 4,679,778 A * | 7/1987 | Tabata | F16F 13/105 | 137/512 |
| 5,927,699 A * | 7/1999 | Nakajima | H02M 3/33576 | 267/140.13 |
| 6,216,830 B1 * | 4/2001 | Kim | F16F 9/34 | 188/266.2 |
| 8,172,209 B2 * | 5/2012 | Muraoka | F16F 13/26 | 267/140.14 |
| 9,765,845 B2 * | 9/2017 | Bradshaw | F16F 13/16 | |

FOREIGN PATENT DOCUMENTS

| | | |
|---|---|---|
| CN | 101825152 A | 9/2010 |
| CN | 202148613 U | 2/2012 |
| CN | 106522034 A | 3/2017 |

* cited by examiner

*Primary Examiner* — Christopher P Schwartz
(74) *Attorney, Agent, or Firm* — Wayne & Ken, LLC; Tony Hom

(57) ABSTRACT

The present invention provides an adaptive vibration isolator. The adaptive vibration isolator includes a hydraulic system, a first elastic member, a second elastic member, an upper top plate, and a vibration energy consumption device. The hydraulic system comprises a hydraulic cylinder, a piston and a piston rod, a first though hole is formed on the piston, and the first hydraulic chamber is communicated with the second hydraulic chamber via the first through hole. An upper top plate passes through the piston rod and the piston from the transmission portion and is connected to the vibration energy consumption device to drive the vibration energy consumption device to move relative to the piston and adjust the effective aperture of the first through hole.

10 Claims, 10 Drawing Sheets

ADAPTIVE VIBRATION ISOLATOR

TECHNICAL FIELD

The present invention relates to the technical field of vibration isolators and in particular to an adaptive vibration isolator.

BACKGROUND OF THE PRESENT INVENTION

Among the present vibration and noise reduction measures in the urban rail transit industry, the floating slab track bed vibration isolation system has been widely applied in the vibration and noise control in the rail transit industry due to its ideal vibration isolation effect and its applicability in high-grade or special areas, for example, hospitals, concert halls, museums and the like, which have higher requirements on vibration reduction. In the floating slab track bed vibration isolation system, elastic vibration isolators are arranged below the track slab to isolate the vibration on the track slab from the foundation, so as to reduce the ambient vibration caused by the rail transit vehicles.

The rigidity of the existing elastic vibration isolators is or almost the linear rigidity. In this floating slab track-vehicle vibration isolation system, the mass will significantly vary because of different loads of the vehicles. This results in great difference in pressure of the existing floating slab track bed vibration isolation system under different loads. Consequently, the performance of the system is different under light loads and heavy loads. The system has poor vibration isolation effect under light loads, and the vertical movement of the track will be too large under heavy loads.

Therefore, the development of an adaptive vibration isolator which can effectively solve the above problems is needed urgently.

SUMMARY OF THE PRESENT INVENTION

An objective of the present invention is to provide an adaptive vibration isolator which is simple in structure, can realize vertical position limitation, and can, or at least partially, maintain good vibration isolation performance in high load and low load states, and maintain stable vertical movement.

Another objective of the present invention is to provide a track bed vibration isolation system which, by using the adaptive vibration isolator of the present invention, can or at least partially maintain good vibration isolation performance in non-load and heavy load states, and maintain stable vertical movement.

To solve the technical problems, the present invention employs the following technical solutions.

The adaptive vibration isolator of the present invention comprises a hydraulic system, a first elastic member, a second elastic member, an upper top plate, and a vibration energy consumption device;

the hydraulic system comprises a hydraulic cylinder, a hydraulic fluid, a piston and a piston rod, and the hydraulic fluid is filled in a hydraulic chamber of the hydraulic cylinder; the piston is arranged within the hydraulic cylinder, is in slide connection to an inner wall of the hydraulic cylinder and separates the hydraulic chamber into a first hydraulic chamber and a second hydraulic chamber, a first though hole is formed on the piston, and the first hydraulic chamber is communicated with the second hydraulic chamber via the first through hole; and, one end of the piston rod is connected to the piston, a passage running through the piston rod and the piston is formed, the piston rod penetrates through and is in slide connection to the top of the hydraulic cylinder, and the part where the piston rod is in slide connection to the top of the hydraulic cylinder is sealed;

the upper top plate comprises a bearing portion and a transmission portion having one end fixedly connected to the bearing portion, the transmission portion is penetrated through the passage and is in slide connection to an inner wall of the passage, and the part where the transmission portion is in slide connection to the inner wall of the passage is sealed;

the vibration energy consumption device comprises a linkage portion and an adjustment portion, one end of the linkage portion is connected to the other end of the transmission portion and the other end of the linkage portion is connected to the adjustment portion to link the upper top plate and the adjustment portion together; the adjustment portion follows the motion of the piston and is in slide connection to the piston to reduce the effective aperture of the first through hole when the upper top plate moves downward; and the first elastic member is used for enabling the upper top plate to return to its original position relative to the hydraulic cylinder, and the second elastic member is used for enabling the upper top plate to return to its original position relative to the piston, so that the vibration energy consumption device returns to its original position.

Preferably, the adjustment portion reduces the effective aperture of the first through hole when the upper top plate moves downward due to a high stress, increases the effective aperture of the first through hole when the upper top plate moves downward due to a low stress, and seals the first through hole when the upper top plate moves downward due to an excessive constant stress.

Preferably the linkage portion comprises a first hinge support, a second hinge support and a connecting rod, the first hinge support is fixedly connected to the other end of the transmission portion, the second hinge support is fixedly connected to the adjustment portion, and two ends of the connecting rod are hinged to the first hinge support and the second hinge support, respectively.

Preferably, the adjustment portion is a movable plate on which a second through hole is formed, and the movable plate is fitted with the first through hole by the second through hole to adjust the effective aperture of the first through hole.

Preferably, the transmission portion and the piston rod are arranged around a same axis and the first through holes are symmetrically formed by using the axis as an axis of symmetry.

Preferably, the bearing portion is a top cover, the transmission portion is a transmission rod, a bottom surface of the top cover is fixedly connected to a top surface of the transmission rod and is T-shaped, and a bottom surface of the transmission rod is connected to one end of the transmission portion.

Preferably, the piston rod and the piston are integrated and inverted-T-shaped.

Preferably, the hydraulic system further comprises a soleplate for the purpose of fixation, the soleplate is connected to the bottom of the hydraulic cylinder, the first elastic member surrounds the hydraulic cylinder, a bottom end of the first elastic member is resisted against a top surface of the soleplate, and an upper end of the first elastic member is resisted against a bottom surface of the bearing portion.

Preferably, an annular neck is formed at the other end of the piston rod, the second elastic member surrounds an upper portion of the transmission portion, and a lower end of the second elastic member is fixedly arranged in the neck and an upper end of the second elastic member is resisted against the bottom surface of the bearing portion.

Preferably, the hydraulic system further comprises a guiderail which is fixedly arranged on the bottom of the piston, a third through hole is formed on the guiderail and communicated with the first through hole, and the movable plate is in slide connection to the guiderail.

The embodiment of the present invention has the following beneficial effects.

In the adaptive vibration isolator of the present invention, the upper top plate drives, when being stressed by an extrusion force, the piston to slide relative to the hydraulic cylinder by the second elastic member and the piston rod, and can also drive the vibration energy consumption device to act to adjust the effective aperture of the first through hole since the second elastic member can generate a restoring force. In a state where the upper top plate is under a high stress, the vibration energy consumption device can reduce the effective aperture of the first through hole, in order to reduce the flow between the first hydraulic chamber and the second hydraulic chamber; in a state where the upper top plate is under a low stress, the vibration energy consumption device can increase the effective aperture of the first through hole, in order to increase the flow between the first hydraulic chamber and the second hydraulic chamber; and in a state where the upper top plate is under an extreme high stress, the vibration energy consumption device can seal the first through hole. Therefore, the adaptive vibration isolator can maintain good vibration isolation performance in high load and low load states of the upper top plate, and maintain stable vertical movement.

BRIEF DESCRIPTION OF THE DRAWINGS

To describe the technical solutions in the embodiments of the present invention more clearly, the drawings to be used in the embodiments will be briefly described below. It should be understood that, the following drawings just show a certain embodiment of the present invention and thus it should not be considered as any limitation to the scope, and a person of ordinary skill in the art may also obtain other related drawings according to these drawings without paying any creative effort.

REFERENCE NUMERALS

Figure 1:
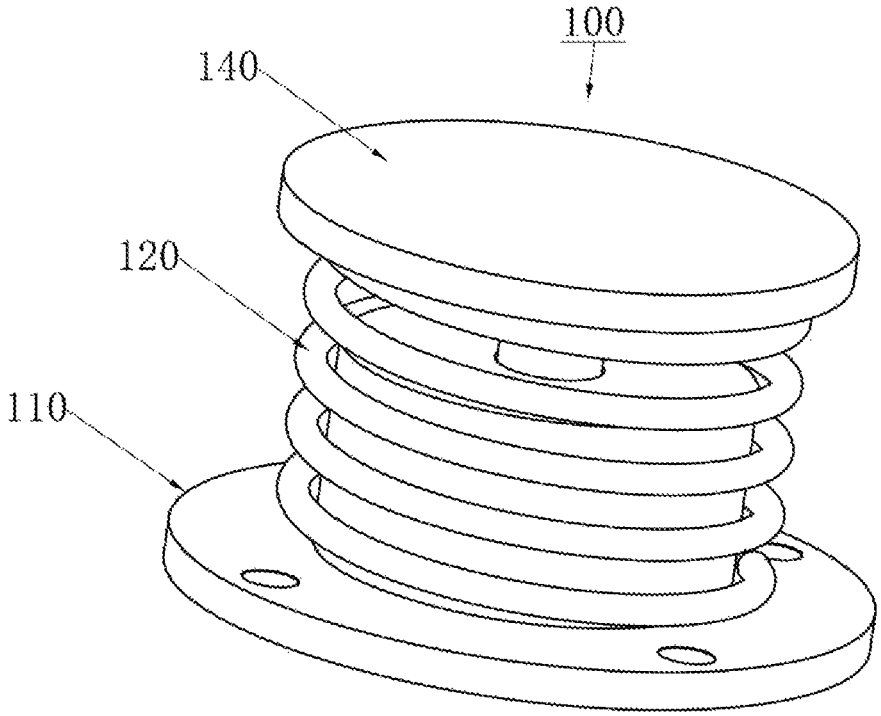
FIG. 1 is a schematic structure diagram of an adaptive vibration isolator according to a specific embodiment of the present invention.

100: adaptive vibration isolator; 110: hydraulic system; 112: hydraulic cylinder; 113: piston; 1131: first through hole; 114: piston rod; 1141: neck; 101: first hydraulic chamber; 102: second hydraulic chamber; 115: guiderail; 1151: third through hole; 1152: slider; 116: soleplate; 120: first elastic member; 130: second elastic member; 140: upper top plate; 141: top cover; 142: transmission rod; 150: vibration energy consumption device; 151: hinge assembly; 1511: first hinge support; 1512: second hinge support; 1513: connecting rod; 152: movable plate; 1521: second through hole; 1522: chute.

DETAILED DESCRIPTION OF THE PRESENT INVENTION

To make the objectives, technical solutions and advantages of the embodiments of the present invention clearer, the technical solutions in the embodiments of the present invention will be described clearly and completely in conjunction with the drawings in the embodiments of the present invention. Apparently, the described embodiments are a part of but not all of the embodiments of the present invention. Usually, components of the embodiment of the present invention described and shown in the drawings may be arranged and designed in various configurations.

Therefore, the detailed description of the embodiment of the present invention in the drawings is not intended to limit the protection scope of the present invention, just to explain the selected embodiment of the present invention. All other embodiments obtained by a person of ordinary skill in the art without any creative effort on the basis of the embodiments in the present invention shall fall into the protection scope of the present invention.

It is to be noted that similar numbers and characters represent similar elements in the drawings. Therefore, an element will not be further defined and explained once it has been defined in a drawing.

In the description of the present invention, it is to be noted that the orientation or position indicated by terms such as "upper" is an orientation or position shown in a drawing, or an orientation or position where the inventive product is usually placed when in use. The use of such terms is merely for describing the present invention conveniently and simplifying the description and does not indicate or imply that the indicated device or element must have a certain orientation or must be constructed and operated in a certain orientation. Therefore, such terms cannot be considered as any limitation to the present invention.

In addition, the terms "first", "second" and "third" are merely descriptive, and cannot be considered to indicate or imply any relative importance.

It is to be noted that, unless otherwise expressly specified and defined, in the description of the present invention, the terms "arrange" and "connection" should be interpreted in a broad sense. For example, the connection may be fixed connection, detachable connection or integral connection; or may be mechanical connection or electrical connection; or may be direct connection or indirect connection by an intermediate member; or, may be internal communication between two elements. A person of ordinary skill in the art may understand the specific meanings of the terms in the present invention according to specific circumstances.

One implementation of the present invention will be described in detail with reference to the drawings. Features in the following embodiments may be combined if not conflicted.

This embodiment provides a track bed vibration isolation system comprising a floating slab track bed and a plurality of adaptive vibration isolators to which the floating slab track bed is connected.

It may be understood that the floating slab track bed is provided to allow vehicles to run thereon. Since the weight of vehicles is different in different load states, the stress applied onto the adaptive vibration isolators is different. Undesirable consequences may be caused if the adaptive vibration isolators do not work or their vertical movement is too large. Meanwhile, it is very important to maintain stable vertical movement to ensure the stable running of vehicles while maintaining good vibration isolation performance.

With the adaptive vibration isolator, the track bed vibration isolation system according to this embodiment can maintain good vibration isolation performance in non-load and heavy load states, and maintain stable vertical movement.

Figure 2:
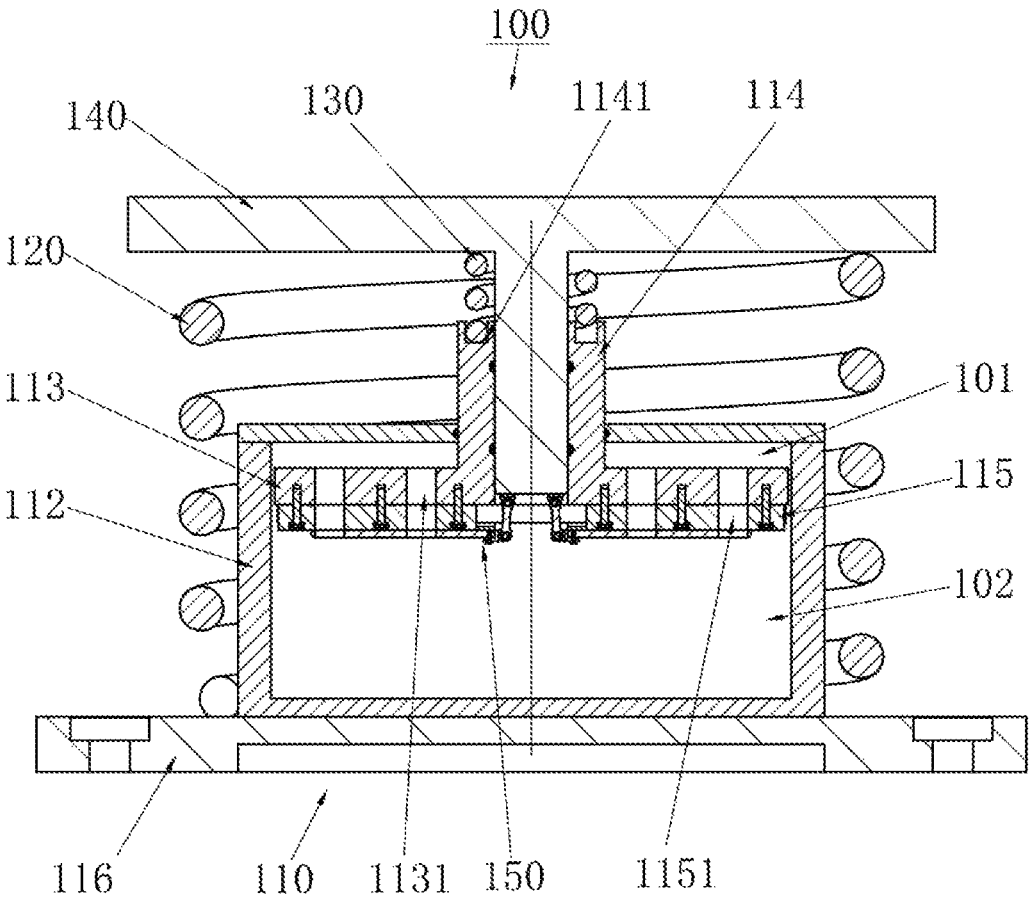
FIG. 2 is a schematic view of a sectional structure of the adaptive vibration isolator according to a specific embodiment of the present invention.

FIG. 1 is a schematic structure diagram of an adaptive vibration isolator 100 according to an embodiment of the present invention. FIG. 2 is a schematic view of a sectional structure of the adaptive vibration isolator 100 according to an embodiment of the present invention. Referring to both FIG. 1 and FIG. 2, the adaptive vibration isolator 100 according to this embodiment comprises a hydraulic system 110, a first elastic member 120, a second elastic member 130, an upper top plate 140, and a vibration energy consumption device 150.

Wherein, the hydraulic system 110 comprises a hydraulic cylinder 112, a piston 113 and a piston rod 114.

The piston 113 is arranged within the hydraulic cylinder 112 and is in slide connection to an inner wall of the hydraulic cylinder 112. The piston 113 separates the hydraulic cylinder 112 into a first hydraulic chamber 101 and a second hydraulic chamber 102, and the first hydraulic chamber 101 and a second hydraulic chamber 102 are used for receiving hydraulic oil.

The piston rod 114 passes through the hydraulic cylinder 112, is connected to the piston 113, and is in slide connection to the hydraulic cylinder 112. A first through hole 1131 is formed on the piston 113, and the first hydraulic chamber 101 is communicated with the second hydraulic chamber 102 via the first through hole 1131.

The piston rod 114 is used for being connected to the upper top plate 140 via the second elastic member 130.

The end face of the upper top plate 140 is used for being connected to the floating slab track bed.

In order to maintain the stability of the structure, in this embodiment, a neck 1141 is formed on an end of the piston rod 114 to be connected to the second elastic member 130.

It is to be noted that, in order to maintain the stability of the structure, in this embodiment, the piston rod 114 is in T-shaped connection to the center of the piston 113, and there are multiple first through holes 1131 formed on the piston 113 to form multiple groups of first through holes. Each group of first through holes comprises multiple first through holes 1131 and the multiple groups of first through holes are symmetrically formed about the piston rod 114.

It should be understood that, in other preferred embodiments, each group of first through holes may comprise only one first through hole 1131.

In this embodiment, the piston rod 114 and the piston 113 are formed integrally. It should be understood that, in other preferred embodiments, the piston rod 114 and the piston 113 may be formed detachably.

In this embodiment, the hydraulic cylinder 112 is symmetrical about its own central axis, and the piston rod 114 coincides with the central axis of the hydraulic cylinder 112.

Figure 3:
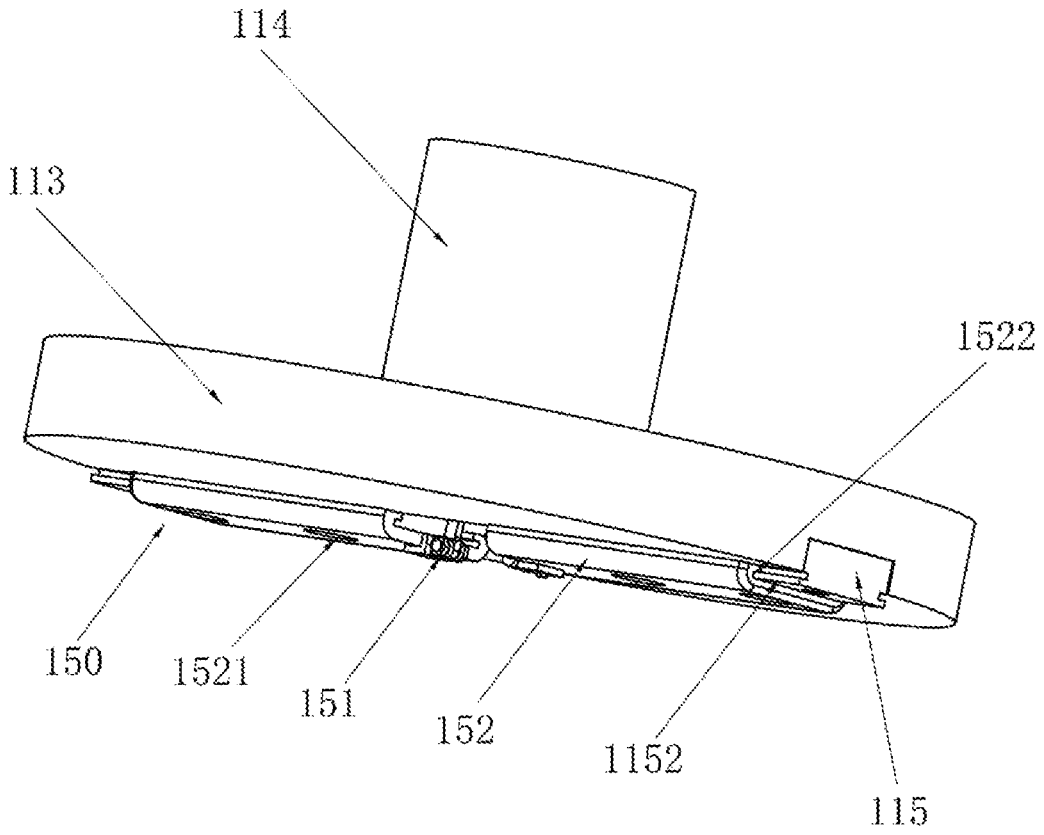
FIG. 3 is a schematic view of a local structure of the adaptive vibration isolator according to a specific embodiment of the present invention.

FIG. 3 is a schematic view of a local structure of the adaptive vibration isolator 100 according to an embodiment of the present invention. Referring to FIG. 3, in this embodiment, in order to be convenient for the installation of the vibration energy consumption device 150, a receiving slot (not shown) is formed on the piston 113. The hydraulic system 110 further comprises a guiderail 115. The guiderail 115 is installed within the receiving slot and forms a slider 1152 with the piston 113 to fit with the vibration energy consumption device 150.

In this embodiment, a third through hole 1151 is formed on the guiderail 115 and the third through hole 1151 is communicated with the first through hole 1131.

It should be understood that, in other preferred embodiments, the slider 1152 may protrude out of the surface of the piston 113.

Also referring to FIG. 2, in order to be convenient for the installation of the first elastic member 120, in this embodiment, the hydraulic system 110 further comprises a soleplate 116. The soleplate 116 is connected to the bottom of the hydraulic cylinder 112 and is used for being fitted with the upper top plate 140 to clamp the first elastic member 120 between the both.

Figure 4:
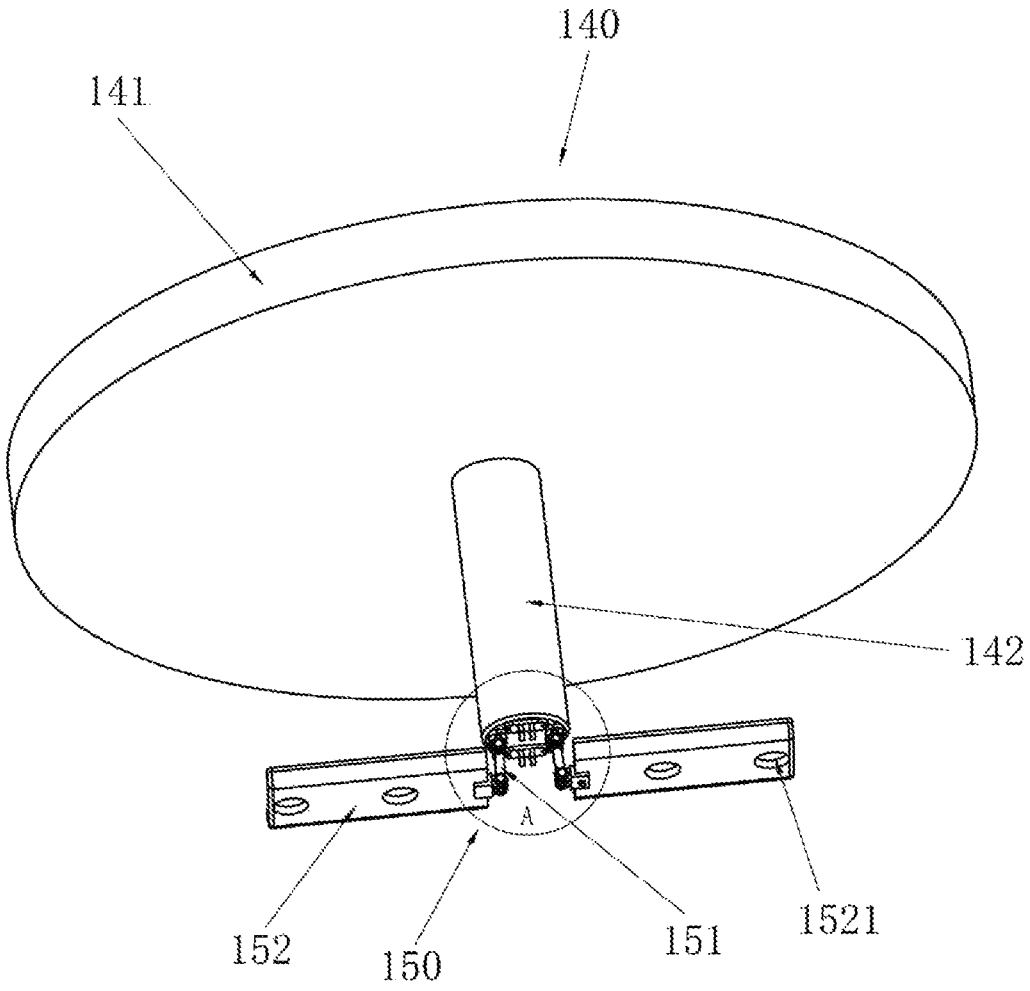
FIG. 4 is a schematic view of another local structure of the adaptive vibration isolator according to a specific embodiment of the present invention.

FIG. 4 is a schematic view of another local structure of the adaptive vibration isolator 100 according to an embodiment of the present invention. Referring to FIG. 4, the upper top plate 140 passes through the piston 113 and is connected to the vibration energy consumption device 150 to drive the vibration energy consumption device 150 to move relative to the piston 113 and adjust the effective aperture of the first through hole 1131.

It should be noted that, the effective aperture mentioned in this embodiment refers to the maximum diameter of an effective hole communicating the first hydraulic chamber 101 with the second hydraulic chamber 102.

In this embodiment, the upper top plate 140 comprises a top cover 141 and a transmission rod 142. The top cover 141 is in T-shaped connection to the center of the transmission rod 142.

Wherein, the top cover 141 is used for being fitted with the soleplate 116 to clamp the first elastic member 120 and is used for being fitted with the piston rod 114 to clamp the second elastic member 130. The transmission rod 142 is used for successively passing through the center of the piston rod 114 and the center of the piston 113, and is connected to the vibration energy consumption device 150.

In this embodiment, the top cover 141 and the transmission rod 142 are formed integrally. It should be understood that, in other preferred embodiments, the top cover 141 and the transmission rod 142 may be formed detachably.

Also referring to FIG. 2, in this embodiment, the first elastic member 120 surrounds the hydraulic cylinder 112, and one end of the first elastic member 120 is resisted against the soleplate 116 and the other end thereof is resisted against the top cover 141.

One end of the second elastic member 130 is clamped in the neck 1141 and the other end thereof is resisted against the top cover 141.

In this embodiment, the first elastic member 120 is a steel spring, the second elastic member 130 is an ordinary spring, and the stiffness of the first elastic member 120 is greater than the stiffness of the second elastic member 130. Also, it should be noted that the stiffness of the first elastic member 120 of the adaptive vibration isolator 100 according to the embodiment is less than the stiffness of a steel spring used in an ordinary vibration isolator.

Figure 5:
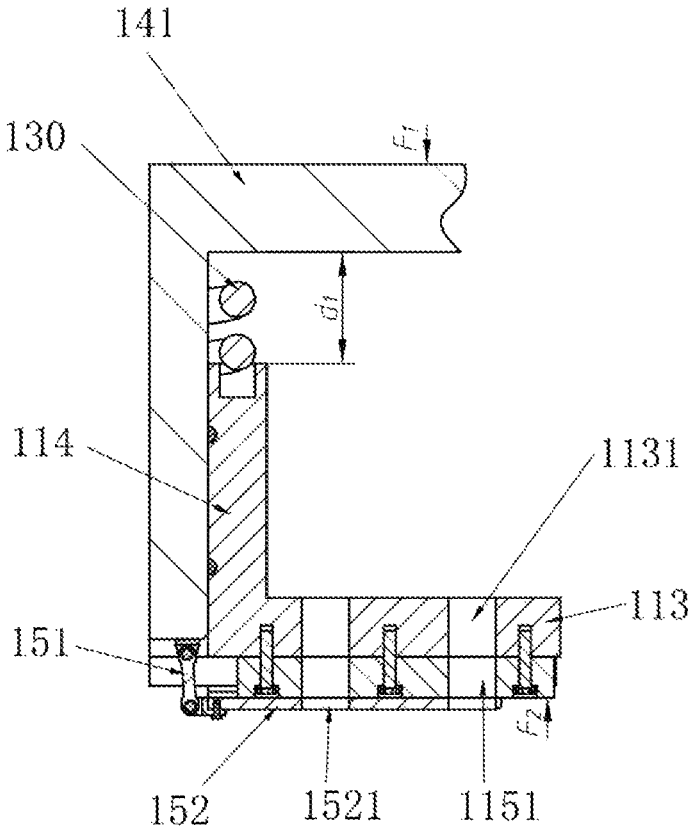
FIG. 5 is a schematic view of the size of an effective aperture under a first working condition of the adaptive vibration isolator according to a specific embodiment of the present invention.
Figure 6:
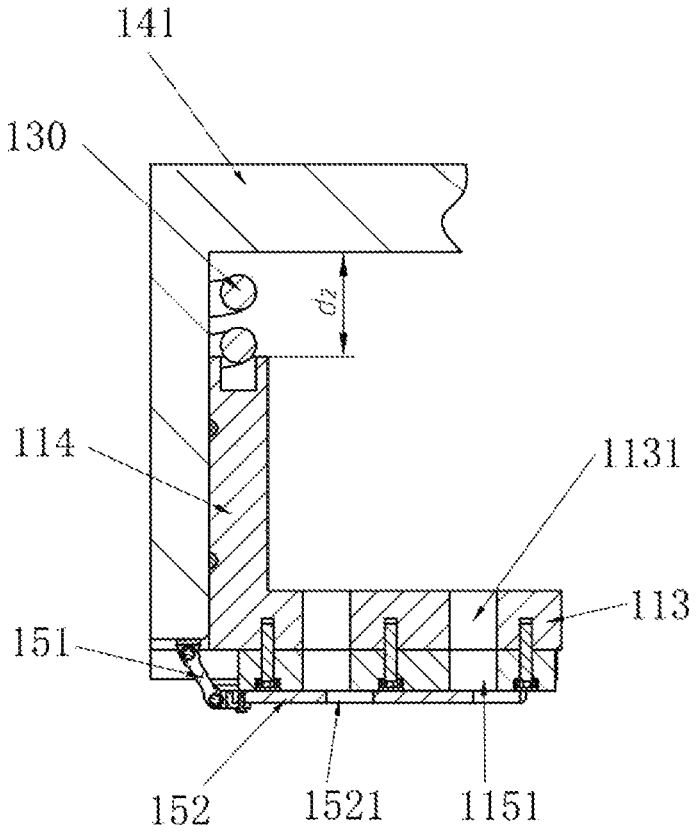
FIG. 6 is a schematic view of the size of an effective aperture under a second working condition of the adaptive vibration isolator according to a specific embodiment of the present invention.
Figure 7:
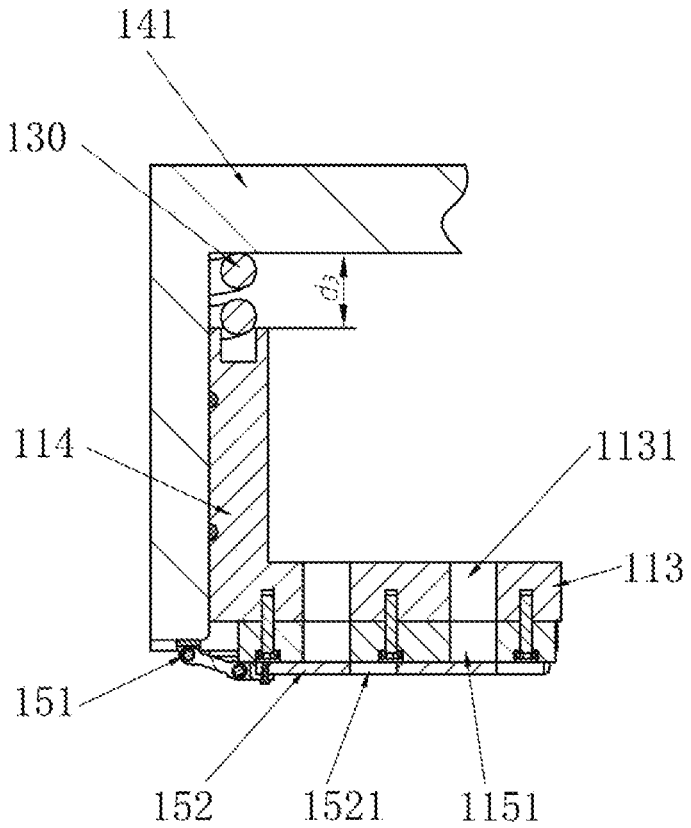
FIG. 7 is a schematic view of the size of an effective aperture under a third working condition of the adaptive vibration isolator according to a specific embodiment of the present invention.

FIG. 5 is a schematic view of the size of an effective aperture under a first working condition of the adaptive vibration isolator 100 according to an embodiment of the present invention. FIG. 6 is a schematic view of the size of an effective aperture under a second working condition of the adaptive vibration isolator 100 according to an embodiment of the present invention. FIG. 7 is a schematic view of the size of an effective aperture under a third working condition of the adaptive vibration isolator 100 according to an embodiment of the present invention. Referring to FIGS. 5 to 7, it should be noted that, in this embodiment, the stiffness coefficient of the second elastic member 130 may be selected by the following steps:

1. the load difference $F_\delta$ can be calculated according to the stress $F_{max}$ of the floating slab under heavy loads (the train is fully loaded) and the stress $F_{min}$ of the floating slab under light loads (the train is unloaded);

load difference: $F_\delta = F_{max} - F_{min}$ 2. the load difference F for each adaptive vibration isolator 100 can be calculated according to the load difference $F_\delta$ and the number n of adaptive vibration isolators 100 arranged below the floating slab;

load difference for each adaptive vibration isolator:

$$F = \frac{F_\delta}{n}$$

3. referring to FIG. 5, the movement $d_\delta$ of the top cover 141, i.e., the maximum vertical movement of the floating slab, can be calculated according to the relative position $d_3$ between the top cover 141 and the top of the piston rod 114 under heavy loads and the relative position $d_1$ between the top cover 141 and the top of the piston rod 114 under light loads;

maximum vertical movement: $d_\delta = d_1 - d_3$ 4. the stiffness coefficient of the second elastic member 130 can be calculated according to the load difference F for each isolator and the maximum vertical movement $d_\delta$;

stiffness coefficient:

$$k_2 = \frac{F}{d_\delta}$$

It may be understood that, in the adaptive vibration isolator 100 of the present invention, the upper top plate 140 drives, when being stressed by an extrusion force, the piston 113 to slide relative to the hydraulic cylinder 112 by the second elastic member 130 and the piston rod 114, and can also drive the vibration energy consumption device 150 to act to adjust the communication aperture of the second through hole 1521 and the first through hole 1131 since the second elastic member 130 can generate a restoring force.

It should be noted that the communication apertures of the second through hole 1521 and the first through hole 1131 mentioned in this embodiment are the effective apertures.

In this embodiment, the vibration energy consumption device 150 comprises a hinge assembly 151 and a movable plate 152 which are connected with each other.

The second through role 1521 is formed on the movable plate 152. The transmission rod 142 of the upper top plate 140 passes through the piston 113 and is connected to the hinge assembly 151. The movable plate 152 can slide relative to the piston 113 in the extrusion force of the upper top plate 140 to adjust the communication apertures of the second through hole 1521 and the first through hole 1131.

Also referring to FIG. 3, in this embodiment, a chute 1522 is formed on two sides of the movable plate 152, and the chute 1522 is in slide fit with the slider 1152.

Figure 8:
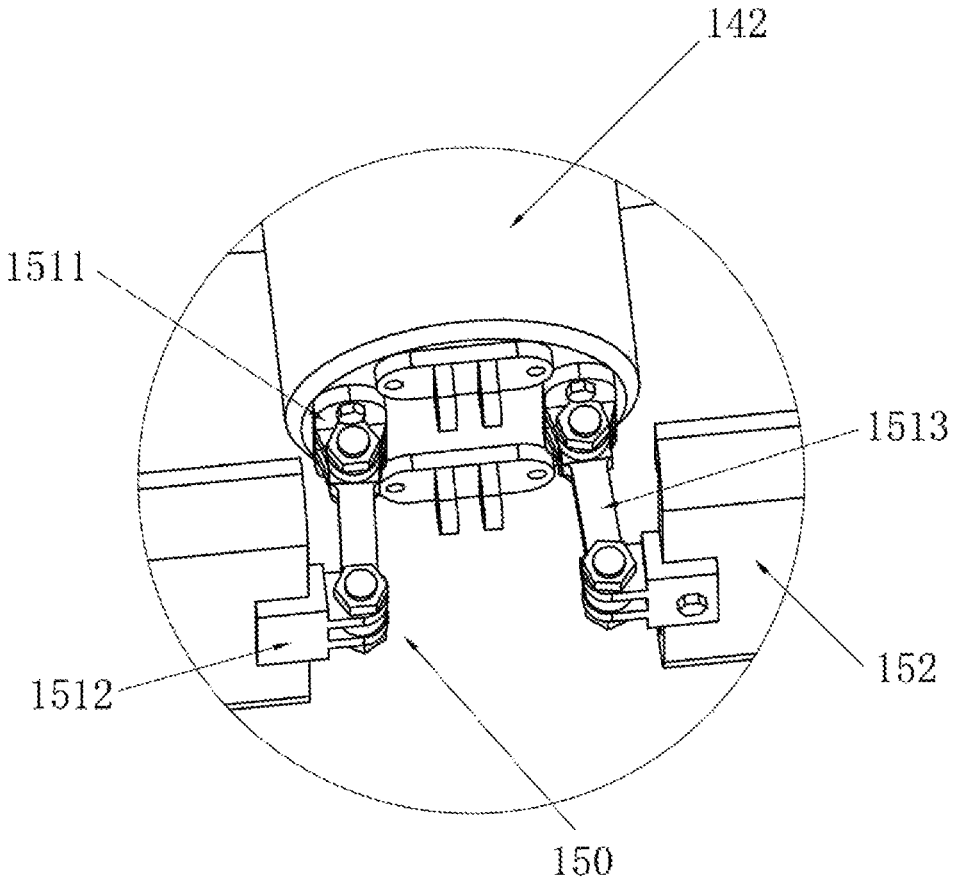
FIG. 8 is an enlarged view of part A of FIG. 4.

FIG. 8 is an enlarged view of part A of FIG. 4. Referring to FIG. 5, in this embodiment, the hinge assembly 151 comprises a first hinge support 1511, a second hinge support 1512 and a connecting rod 1513.

The first hinge support 1511 is connected to one end of the transmission rod 142 of the upper top plate 140, the second hinge support 1512 is connected to one end of the movable plate 152, and two ends of the connecting rod 1513 are hinged to the first hinge support 1511 and the second hinge support 1512, respectively.

It should be noted that, in this embodiment, there are multiple hinge assemblies 151 and multiple movable plates 152, and the multiple movable plates 152 are connected to the upper top plate 140 via the multiple hinge assemblies 151, respectively. Also, the multiple movable plates 152 are symmetrically formed about a central axis of the piston 113.

The multiple first through holes 1131 are formed in one-to-one correspondence with the multiple second through holes 1521.

Figure 9:
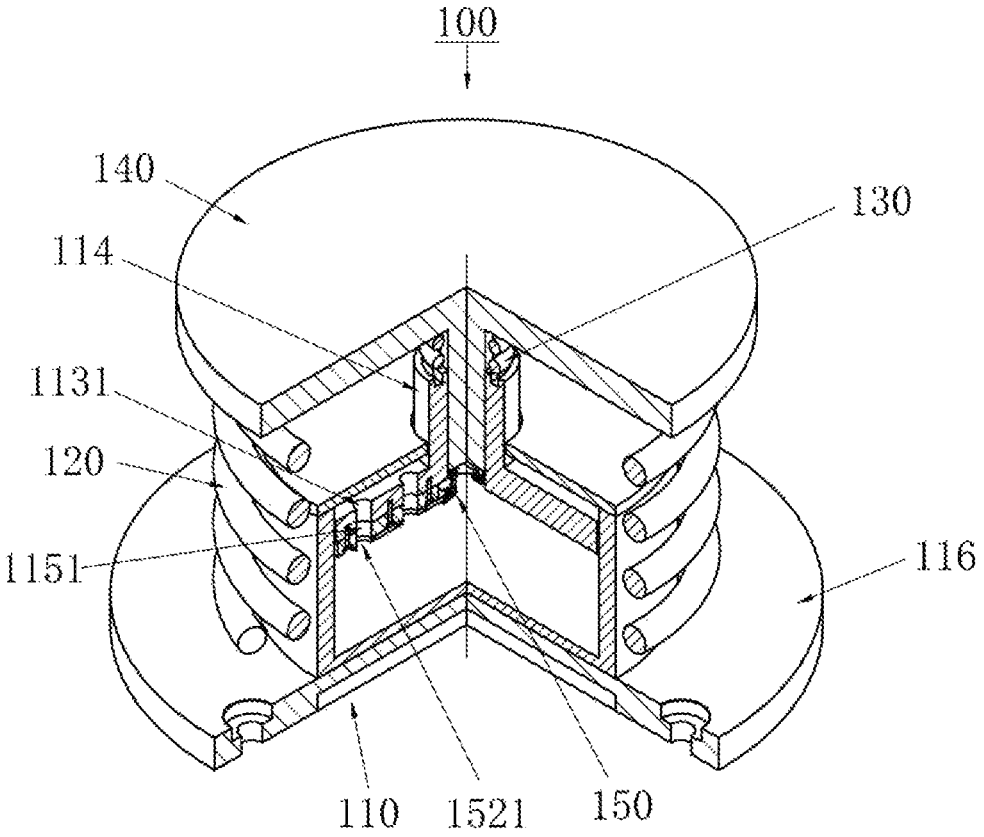
FIG. 9 is a schematic view of another sectional structure of the adaptive vibration isolator according to a specific embodiment of the present invention.

FIG. 9 is a schematic view of another sectional structure of the adaptive vibration isolator 100 according to an embodiment of the present invention. Referring to FIG. 9, it should be noted that, in this embodiment, the diameters of the first through hole 1131, the second through hole 1521 and the third through hole 1151 are equal.

Also, it may be understood that, in a state where no vehicles pass through the track bed, the elasticity of the first elastic member 120 and the second elastic member 130 can support the gravity of the floating slab track bed. In this case, the first through hole 1131, the second through hole 1521 and the third through hole 1151 are communicated completely and the effective aperture is the maximum.

It may be understood that the vibration energy consumption device 150 according to the embodiment can reduce the effective aperture of the first through hole 1131 in a state when the upper top plate 140 is under a high stress, in order to reduce the flow between the first hydraulic chamber 101 and the second hydraulic chamber 102; the vibration energy consumption device 150 can increase the effective aperture of the first through hole 1131 in a state when the upper top plate 140 is under a low stress, in order to increase the flow between the first hydraulic chamber 101 and the second hydraulic chamber 102; and the vibration energy consumption device 150 can also seal the first through hole 1131 in a state where the upper top plate 140 is under an extreme high stress.

Figure 10:
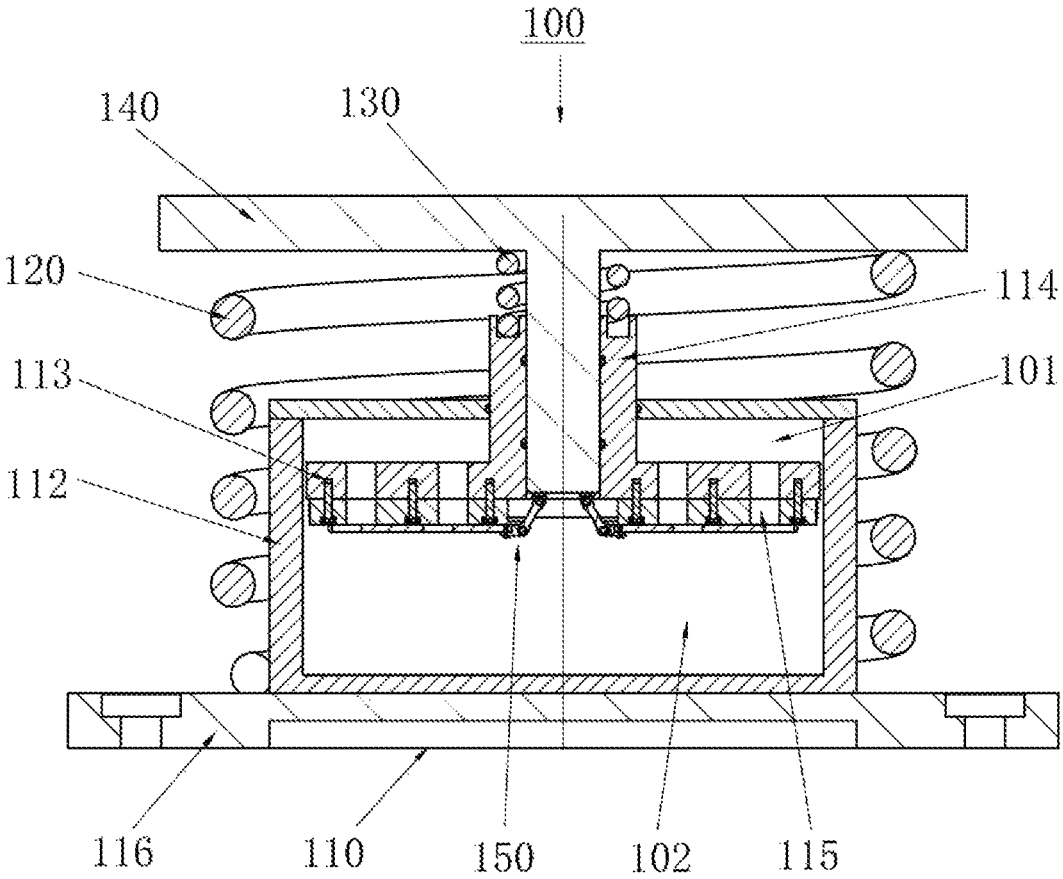
FIG. 10 is a schematic view of a sectional structure in another usage state of the adaptive vibration isolator according to a specific embodiment of the present invention.

FIG. 10 is a schematic view of a sectional structure in another usage state of the adaptive vibration isolator 100 according to an embodiment of the present invention. Referring to FIG. 1 and FIG. 10, when the adaptive vibration isolator 100 is stressed, the relative slide between the upper top plate 140 and the piston 113 causes the rotation of the hinge assembly 151 and then pushes the movable plate 152 so that the position between the second through hole 1521 on the movable plate 152 and the first through hole 1131 on the piston 113 changes relatively. Accordingly, the part of the first through hole 1131 occluded by the movable plate 152 increases or decreases relatively. Therefore, the flow of hydraulic oil through the first through hole 1131 changes to adapt to the overall change in the damping of the adaptive vibration isolator 100.

① Under light loads, the upper top plate 140 is stressed to compress the first elastic member 120 downward. Since the stiffness of the first elastic member 120 of the adaptive vibration isolator 100 is less than the stiffness of a steel spring used in an existing vibration isolator, and by a small damping produced when the first through hole 1131, the second through hole 1521 and the third through hole 1151 are communicated completely in the initial state of the vibration energy consumption device 150, the adaptive vibration isolator is properly applicable to the light-loaded working condition.

The upper top plate 140 is stressed and the top cover 141 extrudes the piston rod 114 by compressing the second elastic member 130. Since the amount of downward movement of the transmission rod 142 and the piston 113 is the amount of compression, the upper top plate 140 moves downward relative to the piston 113. Since the angle of the hinge assembly 151 changes when it is pushed by the lower portion of the upper top plate 140, the hinge assembly 151 pushes the movable plate 152 to move toward two sides. Due to light loads, there is a small amount of movement of the movable plate 152 toward two sides, so that the occluded part of the first through hole 1131 is small and the flow of hydraulic oil through the first through hole 1131 is relatively great. Since the hydraulic system 110 in this case has low damping and low stiffness, and by the external first elastic member 120 with low stiffness, the vibration isolation can be achieved. The problem of poor vibration isolation performance of the ordinary vibration isolator with a steel spring under light loads is solved.

② Under high loads, the working procedure is the same as that under light loads. The difference lies in that, with the increase in loads, the part of the first through hole 1311 occluded by the movable plate 152 becomes larger and the effective aperture of the first through hole 1131 becomes less, so that the pressure in the second hydraulic chamber 102 is higher. This can gradually reduce the amount of compression of the first elastic member 120, prevent the too large vertical movement of the first elastic member 120 under high loads, and maintain good vibration isolation performance.

③ Under extreme heavy loads, the first through hole 1311 is completely occluded by the movable plate 152, and the second hydraulic chamber 102 and the first hydraulic chamber 101 can exchange a small amount of fluid only by a gap between the piston 113 and the inner wall of the hydraulic cylinder 112, so that the compression of the first elastic member 120 and the second elastic member 130 becomes very slow. This also ensures the safety of the adaptive vibration isolator 100 and prevents damage caused by excessive compression ④ After vehicles pass through the track bed, the vibration isolation task is completed. In this case, the adaptive vibration isolator 100 is free of loads of vehicles. The first elastic member 120 and the second elastic member 130 push, under a restoring force, the upper top plate 140 to return to its original shape. The upper top plate 140 enables the movable plate 152 to drive the piston 113 to move upward by the hinge assembly 151, and the movable plate 152 slides toward the inner side relative to the piston 113. The effective aperture of the first through hole 1131 gradually becomes larger and the first through hole 1131 gradually returns to its original shape.

In conclusion, in the adaptive vibration isolator 100 according to this embodiment, the upper top plate 140 drives, when being stressed by an extrusion force, the piston 113 to slide relative to the hydraulic cylinder 112 by the second elastic member 130 and the piston rod 114, and can also drive the vibration energy consumption device 150 to act to adjust the effective aperture of the first through hole 1131 since the second elastic member 130 can generate a restoring force. In a state where the upper top plate 140 is under a high stress, the vibration energy consumption device 150 can reduce the effective aperture of the first through hole 1131, in order to reduce the flow between the first hydraulic chamber 101 and the second hydraulic chamber 102; in a state where the upper top plate 140 is under a low stress, the vibration energy consumption device 150 can increase the effective aperture of the first through hole 1131, in order to increase the flow between the first hydraulic chamber 101 and the second hydraulic chamber 102; and in a state where the upper top plate 140 is under an extreme high stress, the vibration energy consumption device 150 can seal the first through hole 1131. Therefore, the adaptive vibration isolator can maintain good vibration isolation performance in high load and low load states of the upper top plate 140, and maintain stable vertical movement.

In the track bed vibration isolation system in this embodiment, the adaptive vibration isolator 100 can maintain good vibration isolation performance in non-load and heavy load states and maintain stable vertical movement.

The foregoing descriptions are merely preferred embodiments of the present invention and not intended to limit the present invention. For those skilled in the art, various modifications and variations can be made to the present invention. Any modification, equivalent replacement and improvement made within the spirit and principle of the present invention shall fall into the protection scope of the present invention.

What is claimed is:

1. An adaptive vibration isolator, comprising a hydraulic system, a first elastic member, a second elastic member, an upper top plate, and a vibration energy consumption device;

the hydraulic system comprises a hydraulic cylinder, a hydraulic fluid, a piston and a piston rod, and the hydraulic fluid is filled in a hydraulic chamber of the hydraulic cylinder; the piston is arranged within the hydraulic cylinder, is in slide connection to an inner wall of the hydraulic cylinder and separates the hydraulic chamber into a first hydraulic chamber and a second hydraulic chamber; a first though hole is formed on the piston, and the first hydraulic chamber is communicated with the second hydraulic chamber via the first through hole; and, one end of the piston rod is connected to the piston, a passage running through the piston rod and the piston is formed, the piston rod penetrates through and is in slide connection to the top of the hydraulic cylinder, and the part where the piston rod is in slide connection to the top of the hydraulic cylinder is sealed;

the upper top plate comprises a bearing portion and a transmission portion having one end fixedly connected to the bearing portion, the transmission portion is penetrated through the passage and is in slide connection to an inner wall of the passage, and the part where the transmission portion is in slide connection to the inner wall of the passage is sealed;

the vibration energy consumption device comprises a linkage portion and an adjustment portion, one end of the linkage portion is connected to the other end of the transmission portion and the other end of the linkage portion is connected to the adjustment portion to link the upper top plate and the adjustment portion together; the adjustment portion follows the motion of the piston and is in slide connection to the piston to reduce the effective aperture of the first through hole when the upper top plate moves downward; and the first elastic member is used for enabling the upper top plate to return to its original position relative to the hydraulic cylinder, and the second elastic member is used for enabling the upper top plate to return to its original position relative to the piston, so that the vibration energy consumption device returns to its original position.

2. The adaptive vibration isolator according to claim 1, wherein the adjustment portion is a movable plate on which a second through hole is formed, and the movable plate is fitted with the first through hole by the second through hole to adjust the effective aperture of the first through hole.

3. The adaptive vibration isolator according to claim 2, wherein the hydraulic system further comprises a guiderail which is fixedly arranged on the bottom of the piston, a third through hole is formed on the guiderail and communicated with the first through hole, and the movable plate is in slide connection to the guiderail.

4. The adaptive vibration isolator according to claim 1, wherein the adjustment portion reduces the effective aperture of the first through hole when the upper top plate moves downward due to a high stress, increases the effective aperture of the first through hole when the upper top plate moves downward due to a low stress, and seals the first through hole when the upper top plate moves downward due to an excessive constant stress.

5. The adaptive vibration isolator according to claim 1, wherein the linkage portion comprises a first hinge support, a second hinge support and a connecting rod, the first hinge support is fixedly connected to the other end of the transmission portion, the second hinge support is fixedly connected to the adjustment portion, and two ends of the connecting rod are hinged to the first hinge support and the second hinge support, respectively.

6. The adaptive vibration isolator according to claim 1, wherein the transmission portion and the piston rod are arranged around a same axis and the first through holes are symmetrically formed by using the axis as an axis of symmetry.

7. The adaptive vibration isolator according to claim 1, wherein the bearing portion is a top cover, the transmission portion is a transmission rod, a bottom surface of the top cover is fixedly connected to a top surface of the transmission rod and is T-shaped, and a bottom surface of the transmission rod is connected to one end of the transmission portion.

8. The adaptive vibration isolator according to claim 1, wherein the piston rod and the piston are integrated and inverted-T-shaped.

9. The adaptive vibration isolator according to claim 1, wherein the hydraulic system further comprises a soleplate for the purpose of fixation, the soleplate is connected to the bottom of the hydraulic cylinder, the first elastic member surrounds the hydraulic cylinder, a bottom end of the first elastic member is resisted against a top surface of the soleplate, and an upper end of the first elastic member is resisted against a bottom surface of the bearing portion.

10. The adaptive vibration isolator according to claim 1, wherein an annular neck is formed at the other end of the piston rod, the second elastic member surrounds an upper portion of the transmission portion, and a lower end of the second elastic member is fixedly arranged in the neck and an upper end of the second elastic member is resisted against the bottom surface of the bearing portion.

* * * * *